US005979437A

United States Patent [19]

Eberhardt

[11] Patent Number: 5,979,437

[45] Date of Patent: Nov. 9, 1999

[54] AIR CONTROL APPARATUS FOR A FIREPLACE

[76] Inventor: H. Alfred Eberhardt, 1023 Shipp's Landing, 1100 S. Collier Blvd., Marco Island, Fla. 33937

[21] Appl. No.: 08/936,963

[22] Filed: Sep. 25, 1997

[51] Int. Cl.[6] ..... F24B 1/18; F24B 1/188; F23L 1/183

[52] U.S. Cl. ..... 126/517; 126/500; 126/518; 126/533; 126/521

[58] Field of Search ..... 126/515, 517, 126/518, 242, 516, 521, 502, 522, 500, 85 B, 533

[56] References Cited

U.S. PATENT DOCUMENTS

| | | | |
|---|---|---|---|
| Re. 30,725 | 9/1981 | Meeker | 126/516 |
| 4,026,263 | 5/1977 | Boyd | 126/517 |
| 4,066,061 | 1/1978 | Wolford | 126/516 |
| 4,192,458 | 3/1980 | Pinnock et al. | 126/517 |
| 4,213,445 | 7/1980 | Mayo | 126/518 |
| 4,338,914 | 7/1982 | Braswell | 126/518 |
| 4,372,288 | 2/1983 | Nicholas | 126/518 |
| 4,471,756 | 9/1984 | Eberhardt | 126/517 |
| 5,685,290 | 11/1997 | Collins et al. | 126/518 |

*Primary Examiner*—Ira S. Lazarus
*Assistant Examiner*—David Lee
*Attorney, Agent, or Firm*—John F. A. Earley; John F. A. Earley III; Harding, Earley, Follmer & Frailey

[57] ABSTRACT

Air control apparatus for a fireplace prevents or inhibits the buildup of soot and dirt on the inside surface of the glass doors of the fireplace.

A combustion control system for a fireplace for controlling the volume and direction of air circulating through the combustion chamber of a fireplace includes an air control apparatus constructed for insertion underneath a log grate; ducts for conveying an external source of combustion air to an ash pit; an air flow valve in the conveying ducts for controlling the flow of air through the conveying ducts; a filter in the conveying ducts for preventing contaminants from entering the conveying ducts; a thermostat connected to an air flow valve which controls operation of the air flow valve; a forced air heat exchanger functionally connected to the thermostat; a temperature sensing cutoff switch near the heat exchanger; a natural gas log apparatus having a gas flow valve, a burner and ignitor, the gas flow valve and ignitor being functionally connected to said thermostat; and, a booster fan in the conveying means which is functionally connected to the thermostat.

21 Claims, 3 Drawing Sheets

AIR CONTROL APPARATUS FOR A FIREPLACE

BACKGROUND OF THE INVENTION

1. Technical Field

The present invention relates to an apparatus and method of controlling the volume and direction of air circulating through the combustion chamber of a household fireplace having an external source of combustion air.

The present invention more particularly concerns apparatus and method for preventing or inhibiting the build up of soot and dirt on the inside surface of the glass doors of a fireplace.

2. Background of the Prior Art

In recent years, heating efficiency, rather than aesthetic beauty, has become more important to homeowners and builders. For example, many traditional wood-burning fireplaces are being retrofitted or converted to natural gas, artificial-log systems which are more efficient and are cleaner burning than wood-burning systems. However, like traditional wood-burning fireplaces, a natural gas burning system typically draws its supply of combustion air from the room in which it is located, thereby causing heat from the room to escape up the chimney. Therefore, it would be desirable to provide a fireplace system which draws a supply of combustion air from an external or unheated source.

In most fireplaces, the damper is located above the combustion chamber close to the entrance to the flue. This location is undesirable since the damper is difficult to reach and is typically covered with soot. Further, it is difficult to visually detect and adjust the position of the damper. Therefore, it would be desirable to provide a fireplace damper which is highly visible and easily adjustable.

Many fireplaces are now provided with glass door fronts in addition to or in substitution for screens. After prolonged use, aesthetically-undesirable products of combustion (soot) condense on the inside of the glass doors even in gas log systems. The soot build-up obstructs the view through the glass doors and creates an unpleasant appearance. Therefore, it would also be desirable to provide a fireplace system which prevents the accumulation of soot on the inside surface of glass fireplace doors and keep the doors clean.

BRIEF SUMMARY OF THE INVENTION

The present invention relates to a fireplace damper or air control apparatus which is highly visible, easily adjustable, and prevents the accumulation of soot on the inside surface of glass fireplace doors. The present invention also relates to a fireplace system which draws a supply of combustion air from an external or unheated source to improve the efficiency of the fireplace.

The air control apparatus of the invention is constructed for use in a fireplace having a combustion chamber, log grate, glass access doors, an ash pit, an ash pit opening and an external source of combustion air connected to the ash pit opening. The air control apparatus has a two piece construction comprising a cover and an adjustable nozzle portion. The cover has an inlet port constructed and arranged for sealed fluid connection to the ash pit opening, and an outlet port connected to the combustion chamber. The adjustable nozzle portion controls the volume of the air exiting the outlet port of the cover. The nozzle is constructed and arranged to direct upwardly and distribute laterally the air exiting the cover outlet port so that a curtain of upwardly flowing air is formed between the combustion chamber and the glass doors.

The cover comprises a three-sided, rectangular, inverted metal box having a top wall, rear wall, and two side walls. The cover has an open bottom wall or inlet port and an open front or exit port, and an upwardly-extending flange close to the outlet port which forms the nozzle with an upturned flange of the cover. The inlet port of the cover is constructed and arranged to connect with the ash pit opening of a variety of different size and differently located ash pits in the base of a fireplace. The cover is constructed and arranged to be inserted under the log grate.

The nozzle portion comprises a three-sided, rectangular box having a bottom wall, front wall, and two side walls. The nozzle portion has an open top wall and open rear, and a flange extending upwardly from the rear of the bottom wall. The nozzle portion is movable and adjustable between an open position and a closed position and includes a handle fixed to the front wall of the nozzle portion.

The air control apparatus includes means for slidably connecting the cover to the nozzle portion with the outlet port of the cover and the rear of the nozzle portion in fluid communication.

The control apparatus of the present invention is constructed for use in a fireplace having a combustion chamber, a log grate, glass access doors, an ash pit, and an ash pit opening. The system comprises an air control apparatus constructed for insertion underneath the log grate and means for conveying an external source of combustion air to the ash pit.

The air control apparatus includes a cover and an adjustable nozzle portion and adjustable means connecting them together.

The cover has an inlet port constructed and arranged for sealed fluid connection to the ash pit opening, and an outlet port connected to the combustion chamber. The position of the adjustable nozzle portion controls the volume of air exiting the outlet port of the cover. The nozzle portion is also constructed and arranged to direct upwardly and distribute laterally the air exiting the outlet port so that a curtain of upwardly flowing air is formed between the combustion chamber and the glass doors.

The system may also include: an air flow valve for controlling the flow of air through the means conveying the air from outside the home to the combustion chamber; a filter for preventing contaminants from entering said conveying means; a thermostat which controls operation of the air flow valve; a forced air heat exchanger functionally connected to the thermostat; a temperature sensing cutoff switch proximate to the heat exchanger; a natural gas log system having a gas flow valve, burner and ignitor, said gas flow valve and ignitor which is functionally connected to the thermostat; and/or a booster fan in the conveying means, the booster fan being functionally connected to the thermostat.

The present invention provides a method of retarding the build-up of soot on the interior surface of glass fireplace doors of a fireplace. The method comprises the steps of: providing a source of external combustion air and conveying the air to the ash pit opening; controlling the direction of air flow from the ash pit opening into the combustion chamber; and creating an upwardly-flowing curtain of air in between the combustion chamber and the interior surface of the glass doors.

DESCRIPTION OF PREFERRED EMBODIMENTS OF THE INVENTION

Figure 1:
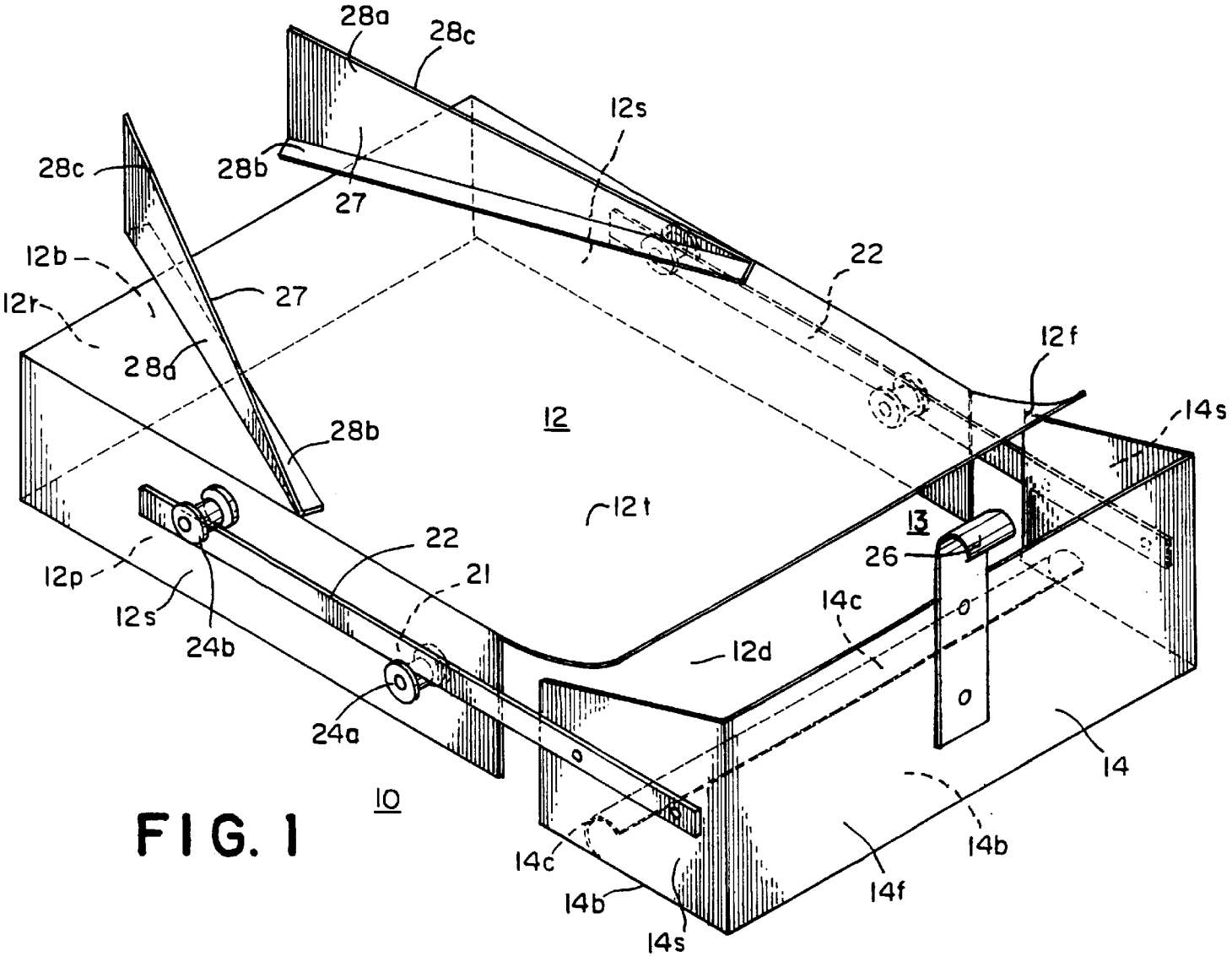
FIG. 1 is a view in perspective of an air control apparatus constructed in accordance with this invention.
Figure 2:
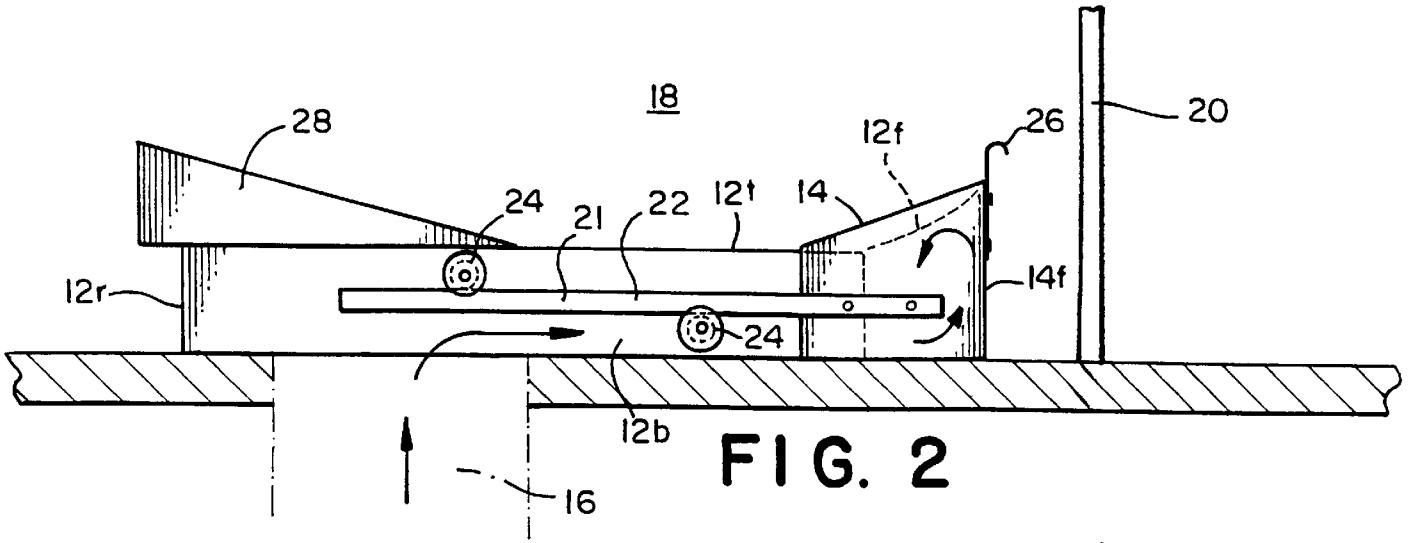
FIG. 2 is a view in side elevation of the apparatus of FIG. 1 in closed position.
Figure 3:
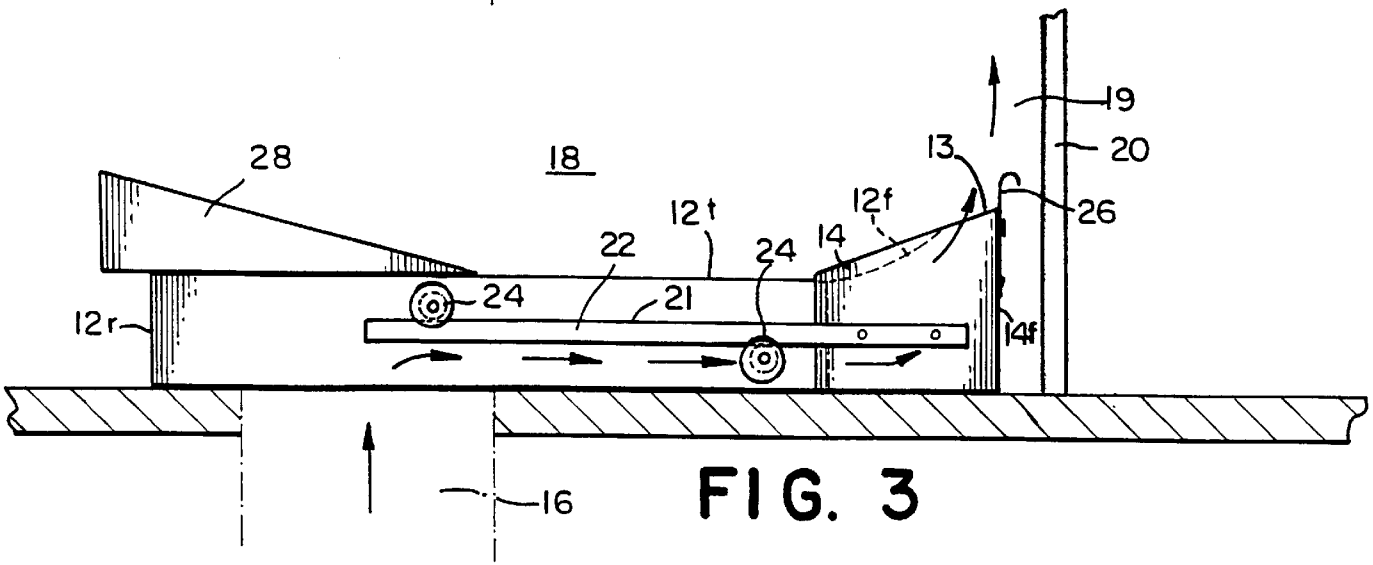
FIG. 3 is a view in side elevation of the air control apparatus of FIG. 1 in open position; and, FIG. 4 is a schematic diagram of the fireplace system of an embodiment of the invention.

The present invention is described with reference to FIGS. 1–4 wherein like reference numerals are used to designate the same components throughout.

The air control fireplace insert 10 of the present invention is shown in detail in FIG. 1 and comprises a generally rectangular cover portion 12 and an adjustable nozzle portion 14. In a preferred embodiment, the fireplace insert 10 is constructed to be placed over the opening in an ash pit 16 in the bottom of a conventional fireplace after the ash pit door has been removed. Once installed, the fireplace insert 10 controls the volume of air which flows into the combustion chamber 18 from the ash pit 16. The insert 10 also directs the flow of air upwardly toward and distributes the air flow across the inside surface of the glass doors 20, thereby creating a curtain 19 of air between the combustion chamber 18 and the glass doors 20. The air curtain 19 is a barrier which deters condensation of combustion products on the interior surface of the glass doors 20.

The fireplace insert 10 may be used in a conventional wood or coal burning fireplace having an ash pit 16 which has been modified to provide an external source of combustion air. The fireplace insert 10 may also be used in a conventional fireplace which has been retrofitted with a natural gas burning system.

The fireplace insert 10 is designed to be placed under a log or coal supporting grate 34 to cover the opening 16*a* of the ash pit 16 after the ash pit door has been removed. Therefore, in a preferred embodiment, the fireplace insert 10 is about 16 inches wide, 13 inches long (deep), and 2 inches high. However, the dimensions of the fireplace insert 10 may be modified to accommodate different size fireplaces, log grates, and ash pit openings.

In a preferred embodiment, the cover 12 comprises a three-sided, rectangular, inverted metal box having a top wall 12*t*, rear wall 12*r*, and two side walls 12*s*. The cover 12 has no bottom wall 12*p*, or alternatively, has a bottom wall with an opening or inlet port approximately the same size as a standard ash pit opening 16*a*. The absence of the bottom wall allows a free flow of air from the ash pit 16 into the internal cover chamber 12*b* created between the cover 12 and the fireplace base.

The cover 12 has an open front 12*d* or exit port with an upturned flange 12*f* which is designed to cooperate with front wall 14*f* of a nozzle portion 14 to control the air flowing through the cover 12. Upturned flange 12*f* and front wall 14*f* form a nozzle opening 13 between them. When the nozzle portion 14 is in the closed position of FIG. 2, the insert 10 creates a fully-enclosed chamber 12*b* over the ash pit opening 16*a*. When the nozzle portion 14 is in the open position of FIG. 3, the flange 12*f* and the wall 14*f* of insert 10 create an adjustable directional channel or nozzle opening 13 between them through which external air from the ash pit 16 flows.

The cover 12 is made of a heat resistant material, preferably sheet metal, which is formed into the three-sided, rectangular box configuration shown in FIG. 1. Other types of heat resistant materials may be used to form the cover 12.

The nozzle portion 14 preferably comprises the three-sided, irregularly-shaped box shown in FIG. 1. In a preferred embodiment, the nozzle portion 14 has a bottom wall 14*b*, front wall 14*f*, and two side walls 14*s*. The nozzle portion 14 has no top wall, or alternatively, has a top wall with an opening which allows combustion air to flow through the nozzle 13. The absence of the top wall allows a free flow of air from the ash pit 16 into the combustion chamber 18 when the nozzle portion 14 is in the fully open position as in FIG. 3, and allows a restricted flow of air when the nozzle portion 14 is in a partially open position. The nozzle portion 14 is also made of a heat resistant material, preferably sheet metal, or the same material from which the cover 12 is made.

The bottom wall 14*b* of the nozzle portion 14 preferably includes an upwardly-extending flange 14*c* near the open end of the nozzle 14 portion. The flange 14*c* is preferably integrally formed with the bottom wall 14*b* and comprises a lengthwise portion of the bottom wall 14*b* which has been bent or formed upwardly, at a fixed angle or along a curve as seen in FIG. 1. The flange 14*c* helps to direct the flow of combustion air upwardly in cooperation with the upwardly-extending flange 12*f* of the cover 12, toward the inside surface of the fireplace doors 20. The flange 14*c* also allows the bottom 14*b* of the nozzle 14 to slide easily over an uneven tile or fire brick surface of the fireplace floor.

The fireplace insert 10 includes a pair of slides 21 which movably connect the cover 12 and the nozzle portion 14. The slides 21 preferably comprise an elongate track 22 fixed to each side wall 14*s* of the front nozzle portion 14 by rivets, and a pair of guide rollers 24*a*, 24*b* mounted on each side wall 12*s* of the cover 12. The guide rollers 24*a*, 24*b* preferably are made of a heat resistant material. Referring to FIG. 1, the bottom of the tracks 22 are supported by the front roller 24*a* while the top of the tracks 22 are supported by the rear roller 24*b*.

The nozzle portion 14 preferably includes a handle 26 fixed to the forward wall 14*f* of the nozzle portion 14. The handle 26 is preferably a strip of sheet metal formed into a hook configuration as seen in FIG. 1. The handle 26 may be easily grasped by the user to push or pull the nozzle portion 14 between the open, closed, and adjustable intermediate positions.

The nozzle portion 14 is constructed to cooperate with the cover 12 to open and close the front end of the cover 12. In the closed position shown in FIG. 2, air flow (depicted by arrows) from the source (such as the ash pit 16) is prevented from entering the combustion chamber 18 of the fireplace. In the open position shown in FIG. 3, air flow (depicted by arrows) is controlled and directed from the source (such as the ash pit 16) into the combustion chamber 18 via a flow path to form an air curtain 19 along the interior surface of the glass fireplace doors 20. The nozzle portion 14 is moved to positions intermediate the open position and the closed position to adjust the amount of air which enters the combustion chamber 18.

The fireplace insert 10 also preferably includes a funnel 27 fixed to the top wall 12*t* of the cover 12. The funnel 27 preferably comprises a pair of 90-degree brackets 28 having a lengthwise taper along the upwardly-protruding portion 28*a*. The base portion 28*b* of the brackets 28 is preferably riveted to the top wall 12*t* of the cover 12. The brackets 28 are preferably oriented inwardly skew to the lengthwise axis of the cover side walls 12s so that the ends 28*c* of the brackets 28 converge at a point remotely behind the rear wall 12*r* of the cover 12 as seen in FIG. 1. The brackets 28 are used to funnel ashes into a depository (such as the ash pit 16). When the cover 12 is tilted towards the depository, ashes which have accumulated on the top surface 12*t* of the cover 12 slide down and are funneled toward the depository ash pit 16.

In operation, the volume of air which enters the combustion chamber 18 is controlled by adjusting the nozzle portion 14 between the open and closed positions. Further, the flow direction of air which enters the combustion chamber 18 is distributed and controlled by the upwardly extending flange 12*f* of the cover 12 and the front wall 14*f* of the nozzle portion 14. As a result, a curtain 19 of upwardly flowing air is created between the combustion chamber 18 and the glass doors 20. The curtain 19 of air deters condensation of soot on the interior surface of the glass doors 20.

Figure 4:
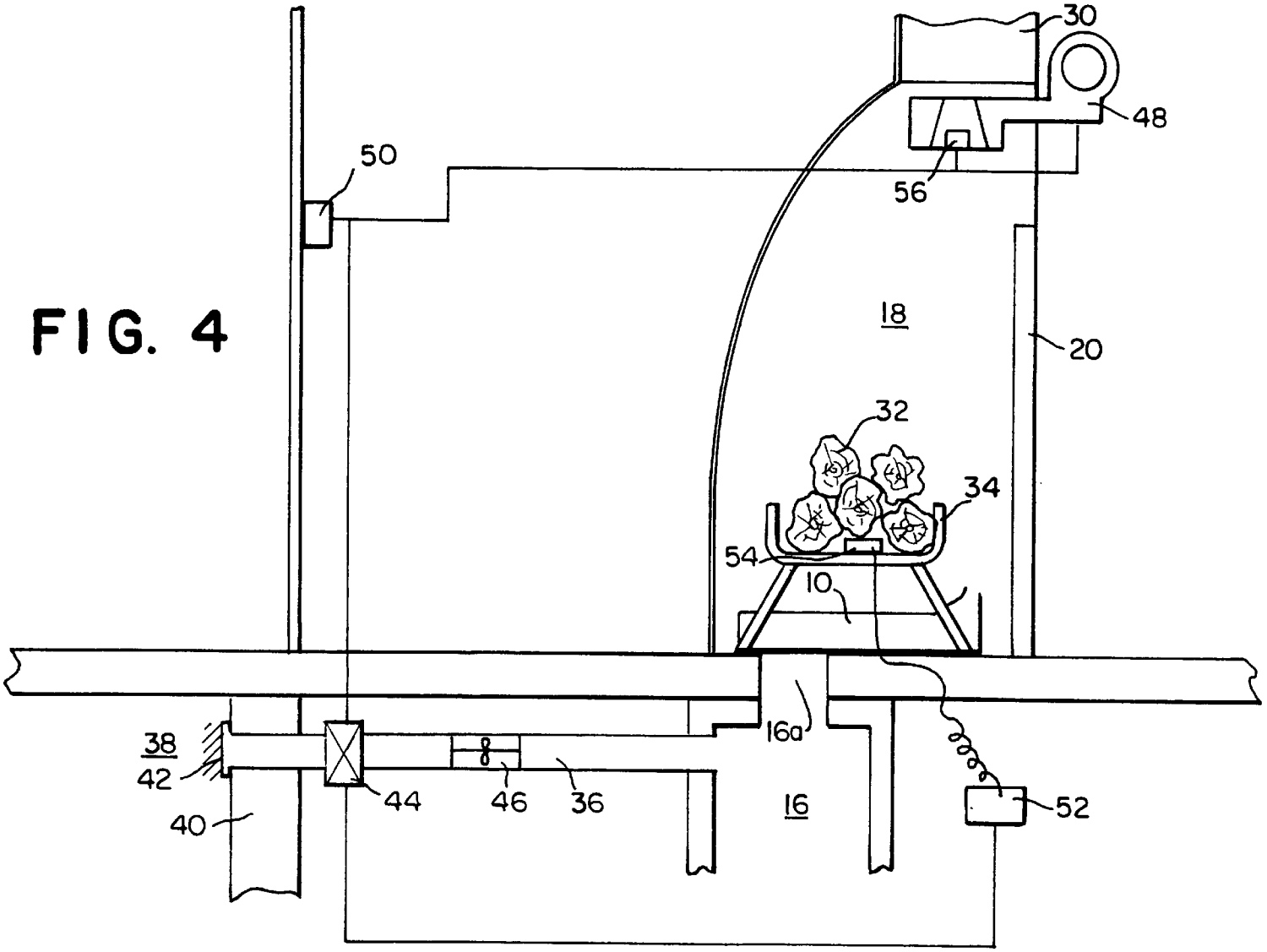

In another embodiment of the invention of FIG. 4, the insert 10 described above is incorporated in a fireplace system which maximizes the efficiency of the fireplace. The fireplace system according to this embodiment controls the flow of combustion air and gas to the combustion chamber 18, and controls a heat exchanger 48 located above the combustion chamber 18.

Referring to FIG. 4, the fireplace system is shown retrofitted in a conventional household fireplace having an ash pit 16, glass fireplace doors 20, and a vertically extending flue 30. The fireplace system includes an air supply duct 36 for conveying air from outside into ash pit 16, which extends from the outside 38 of the house, through the foundation wall 40, to the ash pit 16. Preferably, the air duct originates at the upwind side of the house.

The supply duct 36 includes a screened and/or louvered, corrosion resistant air inlet filter cover 42 at one end, and an air shut-off valve 44 mounted in the duct 36. The duct 36 optionally includes a booster fan 46 mounted between the shut-off valve 44 and the ash pit 16.

The supply duct 36 is preferably made of a combination of 3" O.D. heavy (⅛" wall thickness) P.V.C. tubing and 4" O.D. flexible vinyl tubing. In a preferred embodiment, a piece of P.V.C. tubing extends through a 3" I.D. hole in the foundation wall 40 of the house. The inner end of the P.V.C. tubing is attached to the flexible vinyl tubing via a 3" to 4" connector. The other end of the flexible tubing is connected via a 4" to 3" reducer to a second piece of P.V.C. tubing which extends through the wall of the ash pit 16.

The fireplace system also preferably includes a forced-air heat exchanger 48 located above the combustion chamber 18 near the entrance to the flue 30 such as disclosed in my U.S. Pat. No. 5,572,986, issued Nov. 12, 1996, incorporated herein by reference. The heat exchanger 48 preferably includes a control switch 56 (such as a bi-metallic switch) which senses the temperature of the air entering the flue 30 and turns the blower of the heat exchanger 48 on after the flue 30 and chimney have warmed enough to create a sustainable draft. Additionally, the control switch 56 may be constructed to open and close a gas shut-off valve 52 should the heat exchanger 48 become too hot. Alternatively, a separate temperature sensing control switch may be located near the heat exchanger 48 to close the gas control valve 52 if the temperature of the heat exchanger 48 exceeds an allowable value.

The fireplace system includes a wall thermostat 50 which controls the operation of the heat exchanger 48, air shut-off valve 44, booster fan 46, burner 54, and gas control valve 52. During operation, if the room temperature drops below a preset value, the thermostat 50 automatically opens the air shut-off valve 44 and gas control valve 52, and ignites the burner 54. Once the flue temperature is sufficiently high to ensure a sustainable draft, the blower of the heat exchanger 48 is activated, thereby forcing warm air into the room until the preset temperature is achieved. The system then maintains the preset temperature by selectively operating the air 44 and gas 52 control valves, and the heat exchanger 48.

I claim:

1. Air control apparatus for a fireplace having a combustion chamber, log grate, glass access doors having an interior surface, an ash pit, an ash pit opening and an external source of combustion air connected to the ash pit opening, comprising an air control fireplace insert having a cover having an inlet port and an outlet port, means for forming a sealed fluid connection from said inlet port to the ash pit opening a nozzle portion connected to said cover to form a nozzle opening therebetween for controlling the volume of the air exiting the outlet port of said cover, said nozzle portion including means to direct upwardly and distribute laterally the air exiting the outlet port so that a curtain of upwardly flowing air is formed on the interior surface of the glass access doors, and nozzle opening adjusting means mounted between the cover and the nozzle portion for adjusting the size of the nozzle opening between the nozzle portion and the cover.

2. The air control apparatus recited in claim 1, wherein said cover comprising a three-sided, rectangular, inverted metal box having a top wall, rear wall, and two side walls.

3. The air control apparatus recited in claim 1, said cover having no bottom wall and an open front.

4. The air control apparatus recited in claim 1, said nozzle portion comprising a three-sided, rectangular box having a bottom wall, front wall, and two side walls.

5. The air control apparatus recited in claim 1, said nozzle portion having no top wall and an open end.

6. The air control apparatus recited in claim 1, wherein said cover including an upwardly-extending flange near the outlet port for assisting in directing the combustion air flow.

7. The air control apparatus recited in claim 1, said nozzle portion having an open end and an upwardly-extending flange near the open end for assisting in directing the air against the interior surface of the glass access doors.

8. The air control apparatus recited in claim 1, including means for slidably connecting said cover and said nozzle portion with the outlet port of said cover and the end of said nozzle portion being in fluid communication.

9. The air control apparatus recited in claim 1, said inlet port having means for connecting with the ash pit opening of a variety of different size and differently located ash pits in a base of a fireplace.

10. The air control apparatus recited in claim 1, said nozzle opening adjusting means including means for moving the cover and the nozzle portion toward and away from each other to form an open position and a closed position.

11. The air control apparatus recited in claim 1, including a handle fixed to a front wall of said nozzle portion.

12. The air control apparatus recited in claim 1, said cover being constructed and arranged to be inserted under the log grate.

13. The air control apparatus of claim 1, said fireplace insert including a funnel fixed to the top wall of the cover, said funnel comprising a pair of 90 degree brackets having a lengthwise taper along an upwardly-protruding portion of the brackets, a base portion of the brackets being mounted on the top wall of the cover, the brackets being oriented inwardly skew to the lengthwise axis of the cover side walls so that the ends of the brackets converge at a point remotely behind the rear wall of the cover, whereby the brackets are used to funnel ashes into a depository when the cover is tilted towards the depository so that ashes which have accumulated on the top surface of the cover slide down and are funneled toward the depository.

14. Combustion control apparatus for a fireplace having a combustion chamber, a log grate, glass access doors, and an ash pit with an ash pit opening, comprising:

a) an air control apparatus constructed for insertion underneath the log grate, comprising i) a cover having an inlet port constructed and arranged for sealed fluid connection to the ash pit opening, said cover having an outlet port into the combustion chamber, ii) an adjustable nozzle means for controlling the volume of the air exiting the outlet port of said cover, said nozzle means constructed and arranged to direct upwardly and distribute laterally air exiting the outlet port so that a curtain of upwardly flowing air is formed on the interior surface of the glass access doors;

b) conveying means for conveying an external source of combustion air to the ash pit.

15. The combustion control apparatus recited in claim 14, including an air flow valve in said conveying means for controlling the flow of the combustion air through said conveying means, and a filter in said conveying means for preventing contaminants from entering said conveying means.

16. The combustion control apparatus recited in claim 15, including a thermostat connected to said air flow valve which controls operation of said air flow valve by turning the air flow valve on and off in response to the temperature sensed by the thermostat.

17. The combustion control apparatus recited in claim 16, including a forced air heat exchanger located above the combustion chamber and functionally connected to said thermostat.

18. The combustion control apparatus recited in claim 17, including a temperature sensing cutoff switch near said heat exchanger for sensing temperature of air entering a flue and connected to the heat exchanger and for turning the heat exchanger on.

19. The combustion control apparatus recited in claim 18, including a natural gas log apparatus having a gas flow valve, a burner and ignitor, said gas flow valve and ignitor being functionally connected to said thermostat.

20. The combustion control apparatus recited in claim 19, including a fan in said conveying means for boosting the flow of the combustion air, said fan being functionally connected to said thermostat, said fan being operated in response to temperatures sensed by the thermostat.

21. A method of retarding the build-up of soot on the interior surface of glass doors of a fireplace having a combustion chamber, an ash pit, and an ash pit opening, comprising the steps of:

providing a source of external combustion air and conveying the combustion air to the ash pit opening;

controlling the direction of the combustion air flow from the ash pit opening into the combustion chamber; and creating an upwardly-flowing curtain of the combustion air on the interior surface of the glass doors to keep the glass doors clean.

* * * * *